United States Patent [19]

Cerny

[11] 4,196,915

[45] Apr. 8, 1980

[54] HOCKEY SKATE TIPGUARD

[76] Inventor: Zdenek Cerny, 1148 Sylvania Dr., Mississauga, Ontario, M4Y 2M1, Canada

[21] Appl. No.: 928,186

[22] Filed: Jul. 26, 1978

[30] Foreign Application Priority Data

Jul. 27, 1977 [CA] Canada ..... 283584

[51] Int. Cl.[2] ..... A63C 1/30

[52] U.S. Cl. ..... 280/11.18

[58] Field of Search ..... 280/11.12, 11.14–11.18

[56] References Cited

U.S. PATENT DOCUMENTS

| | | | |
|---|---|---|---|
| 3,026,119 | 3/1962 | Bauer | 280/11.17 |
| 3,095,208 | 6/1963 | Shaw | 280/11.17 |
| 3,101,957 | 8/1963 | Snyder | 280/11.17 |
| 3,322,437 | 5/1967 | Bauer | 280/11.17 |
| 4,131,288 | 12/1978 | Wilson | 280/11.18 |

FOREIGN PATENT DOCUMENTS

| | | | |
|---|---|---|---|
| 2214594 | 10/1972 | Fed. Rep. of Germany | 280/11.18 |

*Primary Examiner*—Joseph F. Peters, Jr.
*Assistant Examiner*—D. W. Underwood
*Attorney, Agent, or Firm*—Ridout & Maybee

[57] ABSTRACT

A protector for the projecting forward end of a hockey skate blade consists of a one-piece moulding of tough resilient plastics material which conforms to the shape of the forward end of the blade and provides a pair of side flanges extending rearwardly from the frontal portion to lie against opposite sides of the blade adjacent the forward end. As applied to a conventional hockey skate having a toe portion extending from the forward end of the blade to the sole plate, the protector may be secured to the blade by means of integral, inwardly facing, opposed abutment flanges which engage the rear edge of the tow portion. In a preferred embodiment of the invention the toe bracket by which the blade is connected to the sole plate includes an elongated bifurcated portion consisting of a pair of bracket members defining therebetween a slot having a frontal opening, and the protector has a medial web which extends into the slot and is retained by the bracket members.

6 Claims, 16 Drawing Figures

FIG.1
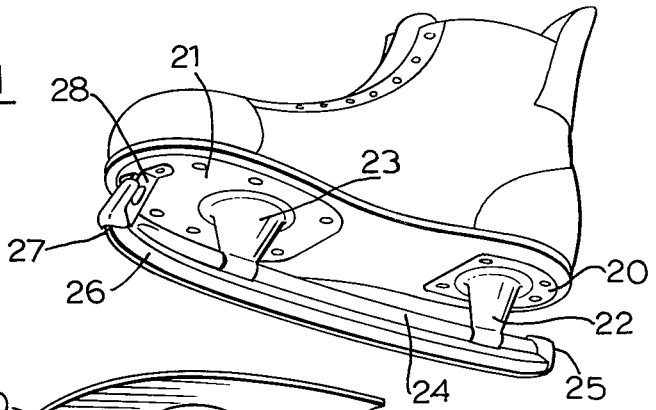
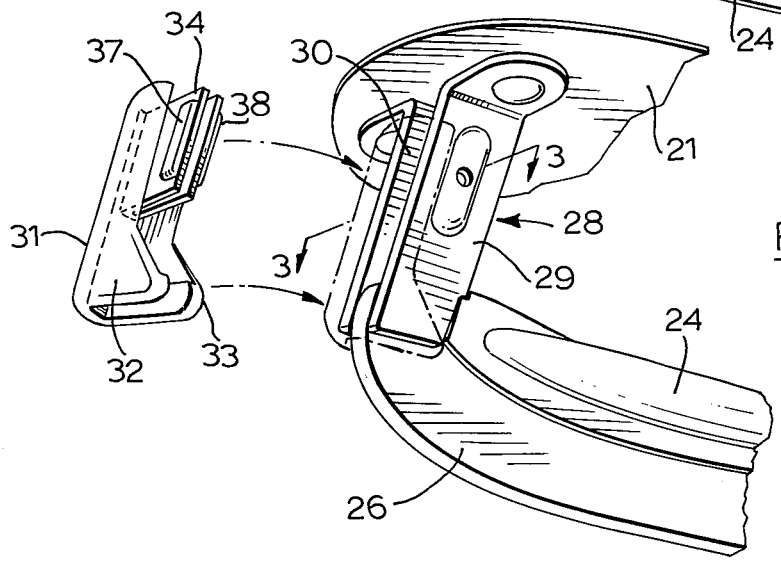
FIG.2
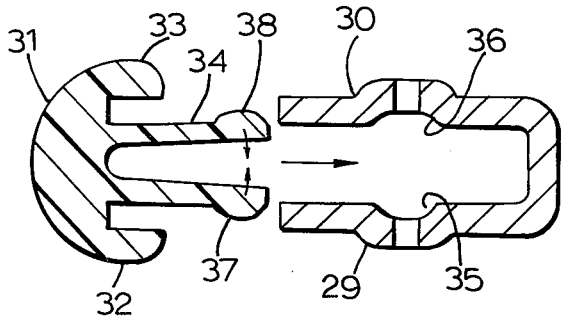
FIG.3
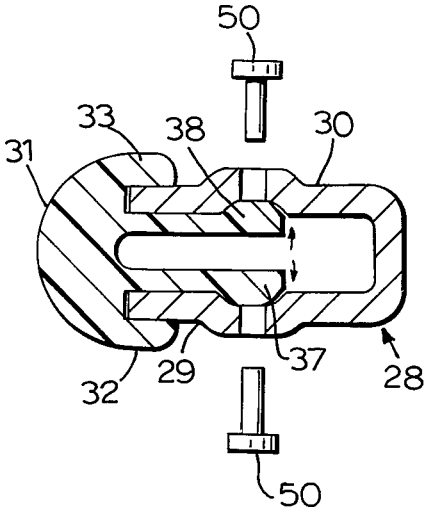
FIG.4

HOCKEY SKATE TIPGUARD

This invention relates to protectors for hockey skate blades. The blade assembly of a conventional hockey skate normally includes an elongated tube with an axial lipped slot formed therein, the slot containing a protruding blade which extends longitudinally and has a forward end projecting beyond the skate structure. The blade includes an integral toe portion extending from the forward end of the blade to a toe bracket by which it is connected to the underside of the sole plate of the skate.

The projecting forward end of a hockey skate blade is a potential cause of injuries, which may be inflicted accidentally or deliberately by players. The likelihood of injury would be greatly reduced were the projecting forward end of the blade protected or shrouded in some way, but the provision of an adequate protector which might be secured to a conventional hockey skate, having regard to the fact that hockey skates differ in size and design, poses problems. It is known to provide rear tip guards for tubular hockey skates; one such tip guard is described in Canadian Pat. No. 627,906 granted to Roy C. Bauer on Sept. 26, 1961. It is also known to provide metallic protectors on speed skates, as described in Canadian Pat. No. 293,550 granted to The Canada Cycle & Motor Co., Limited on Oct. 1, 1929. The present invention, however, by contrast, relates specifically to a protector for the projecting forward end of a hockey skate and means for securing the same.

According to the present invention, a protector for the projecting forward end of a hockey skate blade comprises a one-piece moulding of tough resilient plastics material, the moulding providing a frontal portion conforming to the forward end of the blade a pair of side flanges extending rearwardly from the frontal portion to lie against opposite sides of the blade adjacent the forward end, and means for securing the moulding to the blade. The securing means may comprise integral parts of the moulding which resiliently engage the blade and enable the protector to be applied with a snap-on action. Alternatively the moulding may be clamped in position by means of a separate clamping member engaging an inner edge of the blade and secured to the moulding by self-tapping screws.

In order that the invention may be readily understood several embodiments thereof will now be described, by way of example, with reference to the accompanying drawings, in which:

FIG. 1 is a perspective view of a skate and boot assembly including a protector according to one embodiment of the invention;

FIG. 2 is an exploded perspective view of a detail of FIG. 1;

FIG. 3 is a section on line 3—3 in FIG. 2;

FIG. 4 is a view similar to FIG. 3 with the protector mounted in place;

Figure 5:
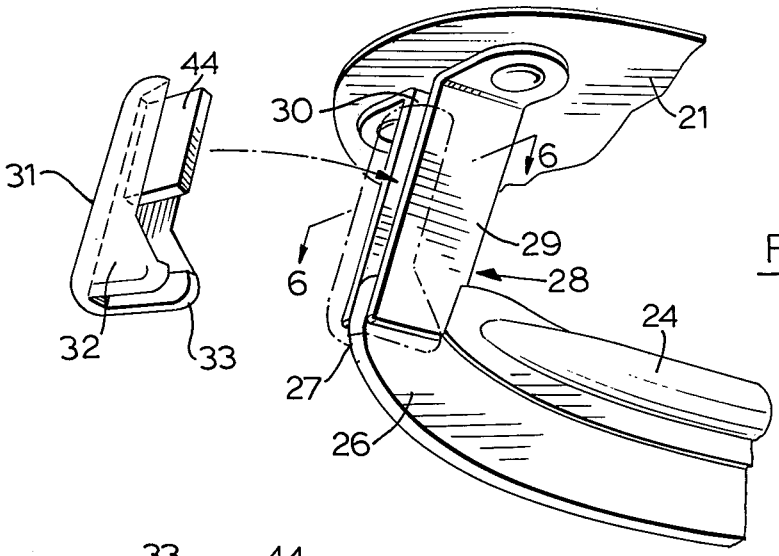
FIG. 5 is an exploded perspective view similar to FIG. 2 showing a second embodiment of the invention.

In the first embodiment of the invention, illustrated in FIGS. 1 to 4, the hockey skate comprises a heel plate 20, and a sole plate 21, which are connected by supports 22, 23 to a longitudinally extending tube 24, the rear end of which is protected by a tip guard 25 of known construction. The tube 24 has an axial lipped slot which contains a protruding skate blade 26, the forward end 27 of which projects beyond the skate structure as shown and is connected to the underside of the sole plate by a toe support. As so far described, the skate is of conventional structure. However, in a conventional hockey skate the toe support of the blade assembly includes an integral toe portion which extends upwardly and slightly rearwardly from the projecting forward end portion of the blade and is connected at its upper end to the underside of the sole plate by a short toe bracket. In the illustrated embodiment, on the other hand, the toe support of the blade is replaced by an elongated toe bracket 28 extending from the sole plate 21 to the front end 27 of the blade, to which it is connected by spot welds. The toe bracket 28 has an elongated bifurcated portion consisting of a pair of bracket members 29, 30 defining therebetween a slot having a frontal opening. The slot is oriented longitudinally so as to be coplanar with the skate blade.

A particular advantage of this modified blade construction is that it is considerably more economical than the conventional construction, since cutting of the blade from a blank produces far less scrap that is produced otherwise where the blade includes an integral upturned toe portion.

A protector is provided for the projecting forward end of the blade assembly. The protector consists essentially of a one-piece moulding of tough resilient plastics material such as, for example, nylon, polypropylene or polycarbonate resin. The moulding includes a frontal portion 31 conforming to the forward end 27 of the blade, a pair of side flanges 32, 33 which extend rearwardly from the frontal portion 31 and resiliently engage the opposite sides of the blade adjacent its forward end, and a pair of rearwardly directed resilient webs 34 which extend between the side flanges. The webs 34 extend into the slot of the bracket 28 and are engaged by the bracket members for securing the moulding in place. In this embodiment of the invention the bracket members 29, 30 are formed with respective opposed notches 35, 36 and the webs 34 of the moulding are formed with integral opposed stud portions 37, 38 which are positioned to engage in the notches for locking the webs in position between the bracket members for securing the protector in position.

In order to remove the protector from the skate, one simply applies pressure to the opposed stud portions 37, 38 by means of a tool 50 (FIG. 4) inserted into the notches from outside the bracket members to disengage the stud portions from the notches thereby enabling the protector to be withdrawn from the bracket.

Figure 6:
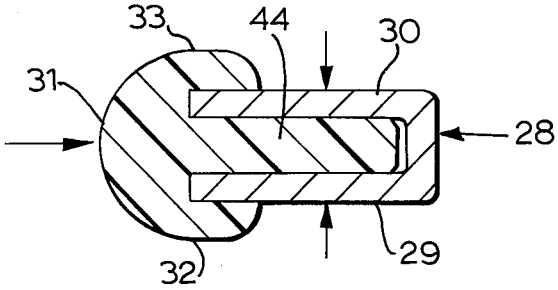
FIG. 6 is a sectional view showing the protector mounted in place.

In the second embodiment of the invention, illustrated in FIGS. 5 and 6, the skate construction is exactly as described above and corresponding parts are denoted by the same reference numerals. The protector also comprises, as before, a one-piece moulding of tough resilient plastics material having a frontal portion 31, a pair of side flanges 32, 33 which extend rearwardly from the frontal portion 31 and resiliently engage the opposite sides of the skate blade adjacent its forward end, and a rearwardly directed web 44 which extends into the slot of the toe bracket 28. However, the bracket members 29, 30 are not notched as in the preceding embodiment, and the web 44 is not formed with resilient outwardly projecting stud portions. Instead, to secure the protector in position, the bracket members are simply clamped onto the web to secure the latter frictionally.

In the third and fourth embodiments of the invention illustrated in FIGS. 7 and 8 and FIGS. 9 and 10, respectively, the hockey skate is of conventional construction. The skate has a heel plate (not shown), and a sole plate 21, which are connected by supports to a longitudinally extending tube, the rear end of which is protected by a tip guard. The tube has an axial lipped slot which contains a protruding skate blade 26, the forward end of which projects beyond the skate structure. The blade is formed with an integral toe portion 39, constituting the support, which extends to a toe bracket 40 by which it is connected to the underside of the sole plate.

Figure 7:
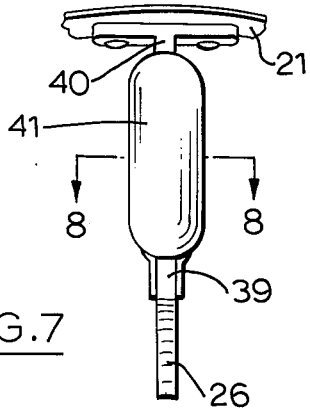
FIG. 7 is a frontal elevational view showing a third embodiment of the invention.
Figure 8:
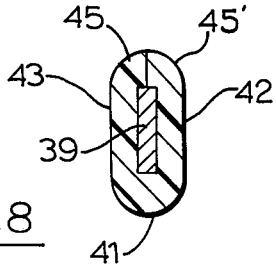
FIG. 8 is a section on line 8—8 in FIG. 7.

As illustrated in FIGS. 7 and 8 a protector for the projecting forward end of the blade 26 comprises a one-piece moulding of tough resilient plastics material. The moulding has an elongated frontal portion 41 which conforms to the front edge of the toe portion 39 of the blade and extends downwardly to cover the forward end. A pair of integral side flanges 42, 43 extend rearwardly from the frontal portion 41 and resiliently engage opposite sides of the blade adjacent the forward end. These side flanges are formed with respective integral, inwardly facing, opposed abutment flanges 45, 45' at their ends, which abuttingly engage the rear edge of the toe 39 to secure the protector in position. In this embodiment of the invention, as in the first, the resilient nature of the protector enables it to be mounted on the skate with a snap-on action.

Figure 9:
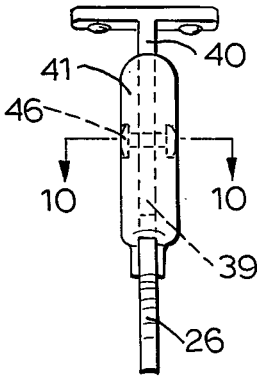
FIG. 9 is a front elevational view showing a fourth embodiment of the invention.
Figure 10:
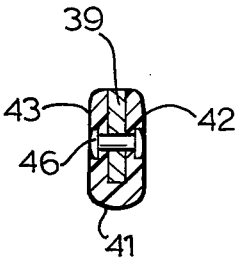
FIG. 10 is a section on line 10—10 in FIG. 9.
Figure 11:
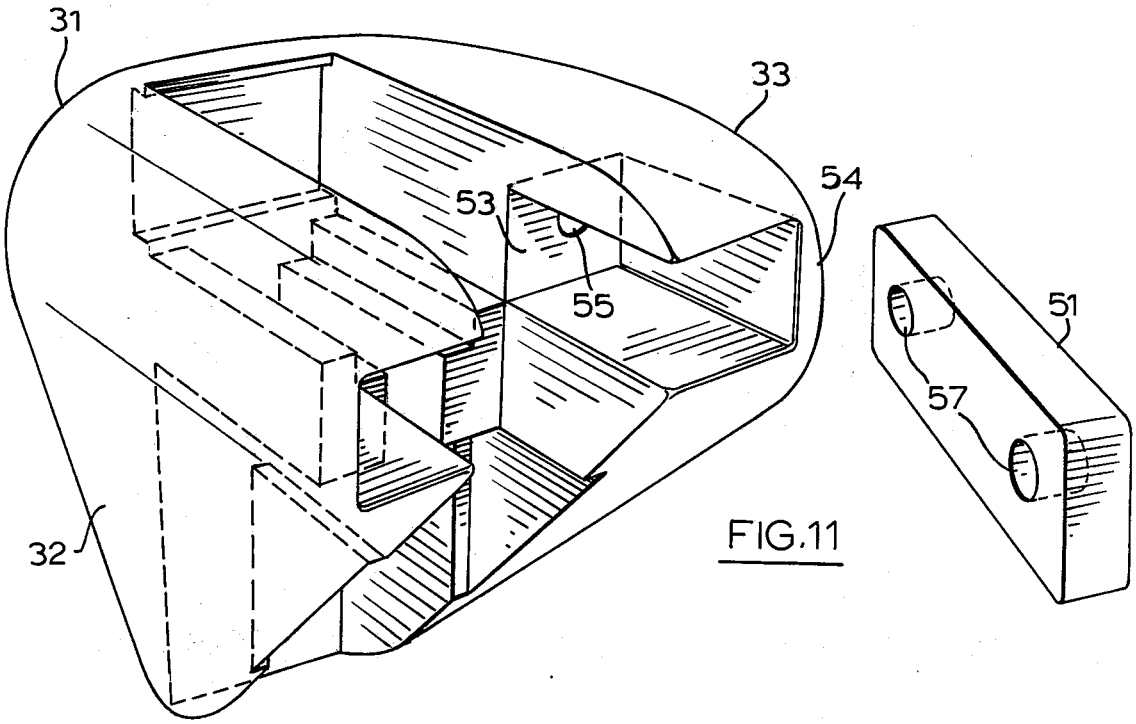
FIG. 11 is an enlarge view of a protector with clamping plate according to another embodiment of the invention.
Figure 12:
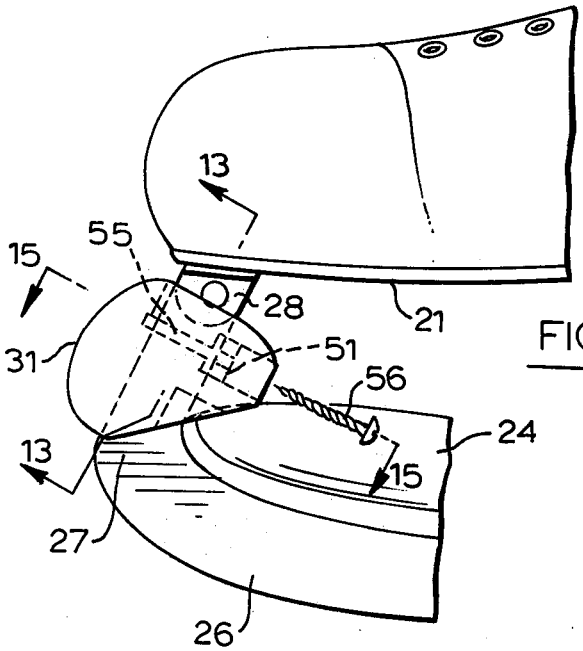
FIG. 12 is a side view showing the protector fitted to a skate.
Figure 13:
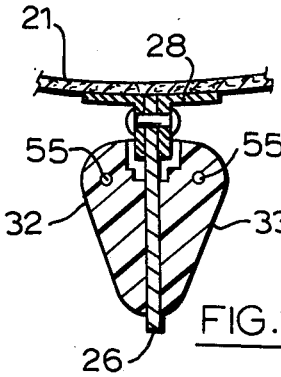
FIG. 13 is a section on line 13—13 in FIG. 12.
Figure 14:
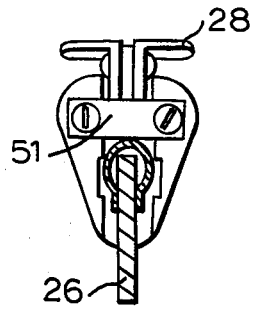
FIG. 14 is a rear view of the protector fitted to the skate.
Figure 15:
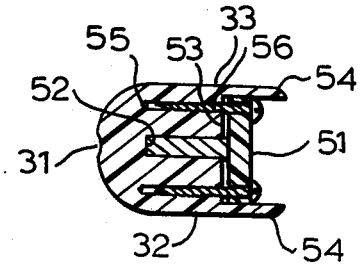
FIG. 15 is a section on line 15—15 in FIG. 12.
Figure 16:
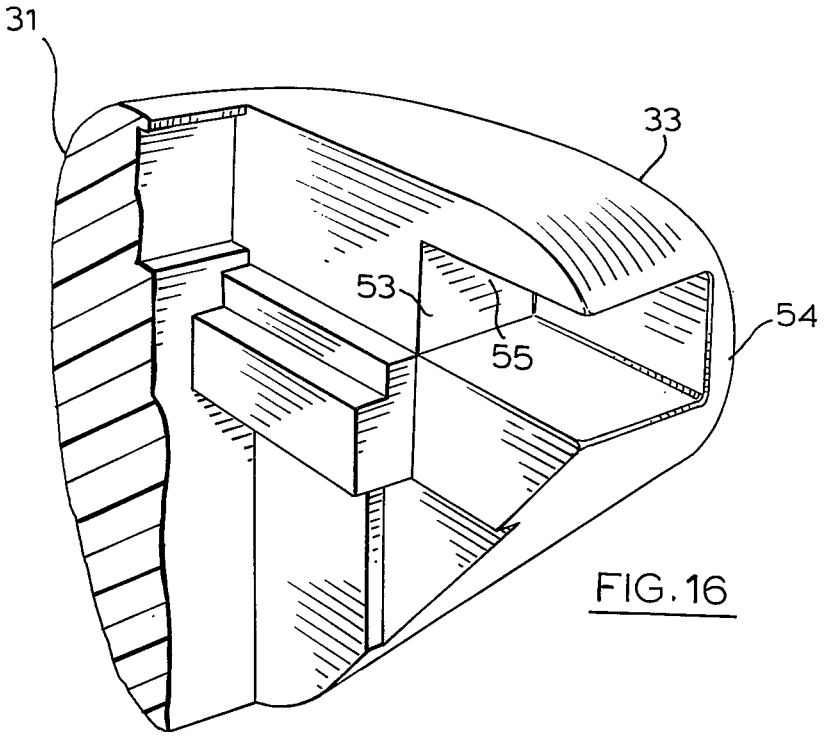
FIG. 16 is a view corresponding to FIG. 11 but in which the protector is shown in half section and the clamping plate is omitted.

Referring now to FIGS. 9 and 10, the protector again comprises a one-piece moulding of tough resilient plastics material having a frontal portion 41 and side flanges 42, 43. However, in this embodiment the protector is secured in position simply by rivets 46 which secure the side flanges directly to the toe portion of the blade.

The toe bracket 28 of FIG. 1 consists of a pair of bracket members 29, 30 connected by web portion at the rear edge of the bracket, and forming a slot with a frontal opening. However, in an alternative embodiment, the bracket members 29, 30 are connected by a web portion at the front edge of the toe bracket and form a slot therebetween with a rearwardly directed opening. In this alternative embodiment the protector is of the type illustrated in FIGS. 7 and 8, the side flanges of the protector having inwardly facing opposed abutment flanges which resiliently engage the rear edges of the bracket members of the toe bracket with a snap-on action for securing the protector to the blade.

In the embodiment of the invention illustrated in FIGS. 11 to 16, the protector comprises a one-piece moulding of tough resilient plastics material which is secured to the blade by a separate clamping member 51. The moulding has a frontal portion 31 and a pair of integral side flanges 32, 33 extending rearwardly from the frontal portion. These side flanges define a slot for receiving the projecting forward end 27 of the skate blade so as to lie against its opposite sides. The base of the slot constitutes a bearing surface 52 of the frontal portion 31, the bearing surface conforming to the shape of the outer or leading edge of the forward end of the blade. Each of the side flanges 32, 33 has a free end which is stepped, thus providing a rearwardly directed face 53 and a rearwardly extending outer wall portion 54, and further provides an internal bore 55 extending from the face 53 for receiving a self-tapping screw 56. The outer wall portions 54 define a pocket which accommodates the clamping member 51, which in the present example is a metal plate having a pair of spaced holes 57 for receiving the self-tapping screws 56, the holes being positioned to align with the bores 55. In the clamped assembly the clamping member 51 engages the inner edge of the skate blade opposite the plastic moulding and is secured to the latter by means of the self-tapping screws 56, the moulding engaging the leading or outer edge of the projecting forward end of the blade and forming a protective shroud therefor.

What I claim is:

1. A protector for the projecting forward end of a hockey skate blade comprising:

a one-piece moulding of tough resilient plastics material having a frontal portion providing a bearing surface conforming to an outer edge of said projecting forward end and a pair of integral side flanges extending rearwardly from the frontal portion to lie against opposite sides of the blade, each of said side flanges having a free end and providing a bore extending forwardly from the free end for receiving a self-tapping screw, a clamping member engageable with an inner edge of said forward end of the blade, the clamping member providing screw-receiving holes positioned to align with said bores, and a pair of self-tapping screws for securing the moulding and the clamping member together in opposed clamping relationship with the moulding engaging and shrouding said forward end of the blade.

2. A protector as claimed in claim 1, wherein the free end of each of the side flanges is stepped to provide a rearwardly directed face from which the bore extends and a rearwardly extending outer wall portion, said wall portions defining a pocket adapted to receive the clamping member in its clamping position.

3. A protector as claimed in claim 2, wherein the clamping member is a metal plate.

4. In combination with a hockey skate having a blade with a projecting forward end and an integral toe portion extending from the said forward end to a toe bracket by which it is connected to the sole plate of the skate, a protector comprising a one-piece moulding of tough resilient plastics material having a frontal portion providing a bearing surface conforming to an outer edge of said projecting forward end and a pair of integral side flanges extending rearwardly from the frontal portion and resiliently engaging opposite sides of the blade, each of the side flanges having a stepped free end proving a rearwardly directed face and a rearwardly extending outer wall portion, each of the side flanges further providing an internal bore extending from the rearwardly directed face, a clamping member engaging an inner edge of said forward end of the blade, the clamping member providing a pair of holes aligned with said bores, and a pair of self-tapping screws extending through the holes into the bores and securing the moulding and the clamping member in opposed clamping relationship with the moulding engaging and shrouding said forward end of the blade, said rearwardly extending outer wall portions of the side flanges defining a pocket housing the clamping member.

5. A protector for the projecting forwarding end of a hockey skate blade, the blade being connected by its forward end to the sole plate of the skate by a toe bracket including a bifurcated portion consisting of a pair of bracket members defining therebetween a slot having a frontal opening which is coplanar with the blade, wherein the protector comprises a one-piece moulding of tough resilient plastics material, said moulding providing a frontal portion conforming to said forward end of the blade, a pair of side flanges extending rearwardly from the frontal portion to lie against opposite sides of the blade adjacent said forward end, the one-piece moulding further comprising a pair of rearwardly directed resilient webs extending between the side flanges to engage in said slot for retention by said bracket members.

6. In combination with a hockey skate having a blade with a projecting forward end connected by a toe bracket extending from said forward end to the sole plate of the skate, the toe bracket including an elongated bifurcated portion consisting of a pair of bracket members defining therebetween a slot having a frontal opening which is coplanar with the blade, a protector consisting of a one-piece moulding of tough resilient plastics material, said moulding providing a frontal portion conforming to said forward end of the blade, a pair of side flanges extending rearwardly from the frontal portion and resiliently engaging opposite sides of the blade ajdacent said forward end, and rearwardly directed web means extending between the side flanges, the web means extending into said slot and being engaged by the bracket members for securing the moulding wherein the bracket members are formed with respective opposed notches, and wherein the web means comprise a pair of resilient web members formed with integral resilient stud portions positioned to engage in the notches for locking the web in position between the bracket members.

* * * * *